United States Patent [19]
Narens et al.
[11] 4,324,824
[45] Apr. 13, 1982

[54] TUFTED PILE FLOOR COVERING WITH PILING OF COATED FIBROUS MATERIAL

[75] Inventors: Daniel S. Narens, Massilon; Harold Reuben, Akron, both of Ohio

[73] Assignee: The Akro Corporation, Canton, Ohio

[21] Appl. No.: 154,131

[22] Filed: May 29, 1980

Related U.S. Application Data

[63] Continuation-in-part of Ser. No. 936,370, Aug. 24, 1978, abandoned.

[51] Int. Cl.[3] ..... D03D 27/06; D05C 17/02
[52] U.S. Cl. ..... 428/92; 428/95; 428/96; 428/97; 428/296
[58] Field of Search ..... 428/85, 92, 95, 96, 428/97, 296; 156/72, 306

[56] References Cited

U.S. PATENT DOCUMENTS

| | | | |
|---|---|---|---|
| 3,775,232 | 11/1973 | Gomory | 428/95 |
| 3,821,066 | 6/1974 | Tillotson | 428/96 |
| 3,837,988 | 9/1974 | Hennen | 428/95 |
| 4,101,302 | 3/1977 | Anderson | 428/95 |
| 4,109,039 | 8/1978 | McCoy | 428/95 |

*Primary Examiner*—Marion McCamish
*Attorney, Agent, or Firm*—Yount & Tarolli

[57] ABSTRACT

A tufted pile floor covering is formed of a flexible polymeric base having a pile composite embedded therein. The pile composite is formed of a primary woven pile backing through which loops of the piling project. The piling is a coated fibrous material. In a preferred embodiment, the coating on the piling is chemically similar to the flexible polymeric base material. In assembling the piling composite on the base, portions of the piling loops projecting on one side of the primary backing are embedded in the flexible polymeric base creating a mechanical lock. Further, when the coating on the piling fibers is chemically compatible with the base material the coating is fused with the material of the flexible polymeric base. Thus, both a chemical and a mechanical lock are achieved between the piling and the flexible polymeric base.

14 Claims, 5 Drawing Figures

TUFTED PILE FLOOR COVERING WITH PILING OF COATED FIBROUS MATERIAL

This application is a continuation-in-part of our copending Patent Application Ser. No. 936,370, filed Aug. 24, 1978, now abandoned.

The present invention relates to an improved floor covering material which is characterized by three distinct layers. The base layer, or secondary backing, is a resilient flexible polymer, preferably derived from a plastisol. An intermediate layer or primary pile backing is provided and is conveniently formed of a woven polyolefin material. The third and upper layer is tufted into the primary pile backing layer, preferably as a continuous looped pile with portions of the loops projecting from both sides of the primary backing. According to the present invention, the piling material is a coated, fibrous material. In a preferred embodiment, the coating on the fibrous material is chemically compatible with the flexible polymeric base layer material. In fabricating the floor covering of the present invention, looped portions of the tufted piling which extend through the primary backing on one side thereof, are embedded in the upper portion of the base layer.

One type of floor covering heretofore available utilizes extruded, elongated, plasticized polyvinyl chloride filaments which are extruded onto a foam backing. These filaments are adhered to the backing and to each other in a random manner to form a nonwoven, nonlooped, randomly interlaced or tangled piling on the foam backing. The piling of this type of floor covering has a tendency to trap dirt. Further, the filaments of the piling, being limited in strength to that of plasticized PVC, have a serious tendency to rupture. Such rupture, particularly as a result of stone cuts, results in the filaments separating from each other as well as from the base layer. This condition often results in large bunches of filaments being cut from the mat piling leaving an unsightly and less useful mat.

The floor coverings of the present invention are characterized by a fiber-reinforced, coated tufted piling supported on a primary pile backing and having lower looped portions of the piling on one side of the backing which are embedded in a flexible polymeric base material. Such a floor covering is easy to clean with a stream of water from a hose and has excellent wear characteristics. The piling is also effective in removing snow, slush, dirt, etc. from shoes.

Still further, the floor coverings of the present invention are substantially unaffected by exposure to moisture, deicing compositions, and granular foreign materials. The improved floor coverings are also amenable to manufacture by a continuous process enabling reproduction of longer and wider strips than those of the aforementioned prior art coverings. The looped pile structure also facilitates the cutting of long strips without unravelling.

Floor covering materials of the present invention are particularly useful as floor coverings for public walkways and doorways subject to contact with snow, ice, slush, and de-icing chemicals. They may be used indoors as well as outdoors.

Various flexible polymeric materials may find utility in the tufted pile floor covering of the present invention. The primary requirement for a flexible polymeric material is that it have the desired flexibility and durability in use. Another feature with regard to the selection of a flexible polymeric material for use as a pile coating or the flexible polymeric secondary backing or base layer in accordance with a preferred embodiment of the invention is that each material selected for its respective function may be chemically compatible with the other to permit fusion bonding as well as the mechanical bonding. As used in this specification, a "chemically compatible" flexible polymer will be understood to mean a flexible polymer which, when applied to or cast with another flexible polymeric material, will be miscible with or soluble in the other so as to chemically fuse and bond with such other flexible polymer under appropriate conditions. Chemical compatibility may be readily determined by those skilled in the art. As used in this specification, the term "flexible polymer" or "flexible polymeric material" will be understood to mean a material, usually incorporating a plasticizer, blending resin or the like, having flexibility and durability sufficient to provide acceptable wear characteristics in the resultant floor covering.

Briefly, the present invention is a floor covering having a flexible polymeric base, or secondary backing, and a fabric supported piling of flexible polymer coated threads which are mechanically bound by the flexible polymeric base. The piling comprises a dense array of threads extending from the woven primary backing to form an upper exposed pile surface, preferably a looped pile surface, and a lower looped surface projecting downward below the primary pile backing for embedment in the base. In a preferred embodiment, the base and the coating material of the piling are chemically compatible so that there is chemical bonding between these materials as well as the mechanical interlock between the base and piling loops.

The primary pile backing into which the piling is tufted is desirably formed of a chemically dissimilar synthetic or natural fiber, and is a woven or nonwoven fabric. The function of the primary backing is to retain the piling loops in their proper relationship prior to embedment in the base layer. After embedment, the primary backing serves no significant purpose.

Numerous advantages result from the construction of a floor covering in accordance with the present invention. Because the piling is tufted, dirt is not entrapped between the regular, evenly spaced loops. Cleaning is therefore possible by merely a spray of water preferably directed against the "grain" of the piling. Because the piling fibers are mechanically interlocked with the base, long term durability of the floor covering is enhanced. Also, because the tufted piling is formed from a fibrous material with a flexible polymeric coating thereon, the piling is reinforced and thus has much greater strength, durability and resistance to mechanical degradation, such as stone cuts, when compared to prior art floor coverings comprising extruded polymer filaments having no reinforcing fibrous core.

BRIEF DESCRIPTION OF THE DRAWINGS

These and other features and advantages of the invention will become apparent upon consideration of the following description taken in conjunction with the accompanying drawings forming a part of this specification and in which.

DETAILED DESCRIPTION OF ONE PREFERRED EMBODIMENT AND THE DRAWINGS

Figure 1:
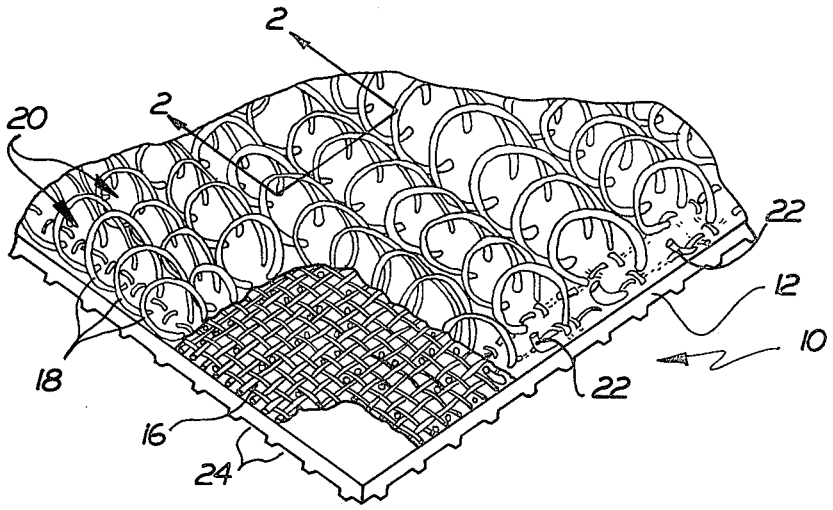
FIG. 1 is a fragmentary, partially cut away perspective view of a floor covering in accordance with the present invention.
Figure 2:
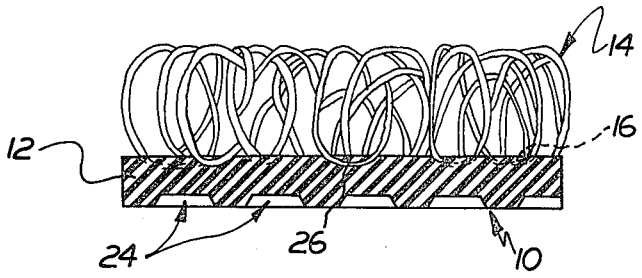
FIG. 2 is a cross sectional view on an enlarged scale of the floor covering shown in FIG. 1 as it appears in a plane indicated by line 2—2 thereof.
Figure 3:
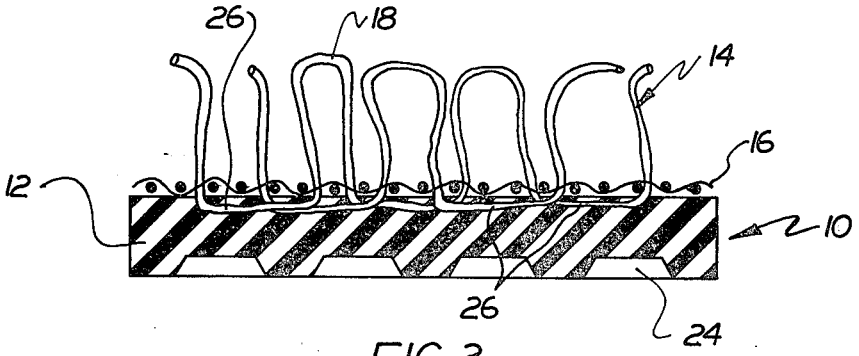
FIG. 3 is a cross sectional view on an enlarged scale showing a tufted piling and primary backing with the underside of the piling threads embedded in the base in accordance with the present invention.

Referring now to the drawings which are presented for the purposes of illustrating a preferred embodiment of the invention only and not for purposes of limiting the scope of the invention, FIGS. 1-3 show a floor covering 10 comprising a base layer or secondary backing 12 and a looped tufted piling 14 secured thereto. The looped piling 14 is supported on a primary pile backing 16. As shown in FIG. 1, the piling 14 is composed of a plurality of loops 18 arranged in rows 20, each row 20 being formed from a single continuous thread 22 tufted into the pile backing 16 and having discrete upper looped portions 18 projecting from the upper side of the primary backing 16. The underside of the base layer 12 is desirably textured or roughened as indicated by indentations 24 to confer a non-slip characteristic to the floor covering 10. Although a looped tufted piling 14 is preferred, the projecting loops 18 on the upper surface of the floor covering 10 may be cut if desired.

The primary backing 16 is a woven backing material conveniently formed of flat strands of a synthetic, resinous material such as polyolefin, e.g., polypropylene. Instead of a synthetic material, the primary backing 16 may be formed of natural fibers, e.g., jute, hemp, or the like. Optionally, the primary pile backing 16 may be nonwoven.

The piling 14 is formed of a plurality of threads 22 comprising a core of fibrous material coated with a flexible polymeric material. In one preferred embodiment of the invention (FIG. 4), the core of the threads 22 comprises bundles of polyester filaments 28 with a flexible poly(vinyl chloride) coating material 30 thereon. The coated threads 22 used to produce the piling 14 may be made by known methods and are available commercially.

While a poly (vinyl chloride) coated thread comprises one preferred, commercially available coated thread, other coating materials may be used. The coated thread must be tuftable and it is preferable that the thread coating material 30 is chemically compatible with the material from which the base layer 12 of a mat is formed. The material used for either the coating material or the base layer is generally a vinyl chloride plastic material but, more specifically, is preferably independently selected from a group consisting of homopolymers of vinyl chloride, copolymers thereof with a vinyl ester, such as poly(vinyl chloride-vinyl acetate) and mixtures thereof. As used in this specification, the term vinyl chloride plastic will be defined as a polymeric material made by the polymerization of vinyl chloride with not more than equal weights of other unsaturated compounds. This definition appears in *Plastic Engineering Handbook,* 3rd Edition, Reinhold Publishing. Thus, in addition to vinyl chloride homopolymers and copolymers, the flexible polymeric material selected may also include mixtures of homopolymers, copolymers and/or alloying or blending polymers, as well as coloring compounds, fillers, plasticizers, stabilizers, fungicides, and, particularly for the base layer, blowing agents to create a foamed base.

In accordance with one preferred embodiment of the present invention, the piling 14 is fused to the base layer 12. FIGS. 2 and 3 show in detail the embedment of lower portions 26 of the piling loops 14 which extend through the underside of the primary backing 16 and into embedded relation with the base layer 12. When the coating 30 on the lower portions of the piling 26 are of a material which is chemically compatible with the material of the base layer 12, a chemical bond is formed by the fusion of the coating and base layer materials.

Figure 4:
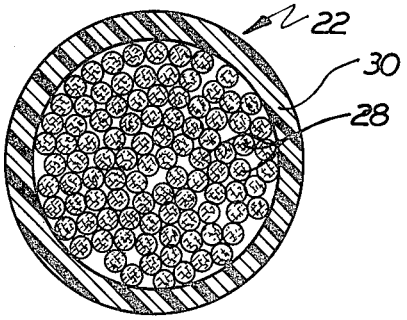
FIG. 4 is a cross sectional view on a much enlarged scale of a piling thread used in accordance with the present invention.

Several methods of coating the single piling threads 22 may be employed. Among these, one particularly advantageous method of coating is cross head extruding an elastomeric coating onto a bundle of strands to form a thread having a sheath coating 30 that does not penetrate internally of the fibrous core of filaments 28 of the thread 22 as shown in FIG. 4. Alternatively, dipping of the filaments 28 into a flexible polymeric solution or plastisol may be used to apply the coating 30 to form the coated threads 22.

The preferred fibrous material from which the coated threads 22 are formed is a polyester fiber 28 made of a bundle of about 30-150 strands, the strand bundle being about 500 to 1000 denier. The bundle of strands has a coating 30 thereon of about 1 to 10 mils thick. Instead of a polyester, such as poly (ethylene terephthalate) filament, other synthetic or natural filaments or strands may be used such as nylon, glass, rayon, cellulose acetate, cotton, etc.

As shown in FIG. 4, a cross section of a preferred pile thread 22 is composed of a core of a plurality of fibrous filaments 28 encased in a relatively thin (1 to 10 mils) coating 30. Although the cross section of a thread 22 illustrates a wholly external coating 30, which is preferred, it will be understood that the coating material may permeate the filaments 28 forming the core of the thread 22. The core desirably has a tensile strength greater than the tensile strength of the flexible polymeric coating, and thus, serves as a reinforcing element for the coating material.

As stated above, the material from which the coating is made may include various fillers, extenders, pigments, etc. From 5 to 20% by weight of solid particulate material may be dispersed in the thread coating to provide color, inexpensive extending filler, nonslip qualities, reflective properties, fire retardant properties, etc.

Tufting of the flexible polymer coated thread 22 through the primary pile backing 16 to form a pile/primary backing composite may be accomplished by known procedures on known equipment.

Figure 5:
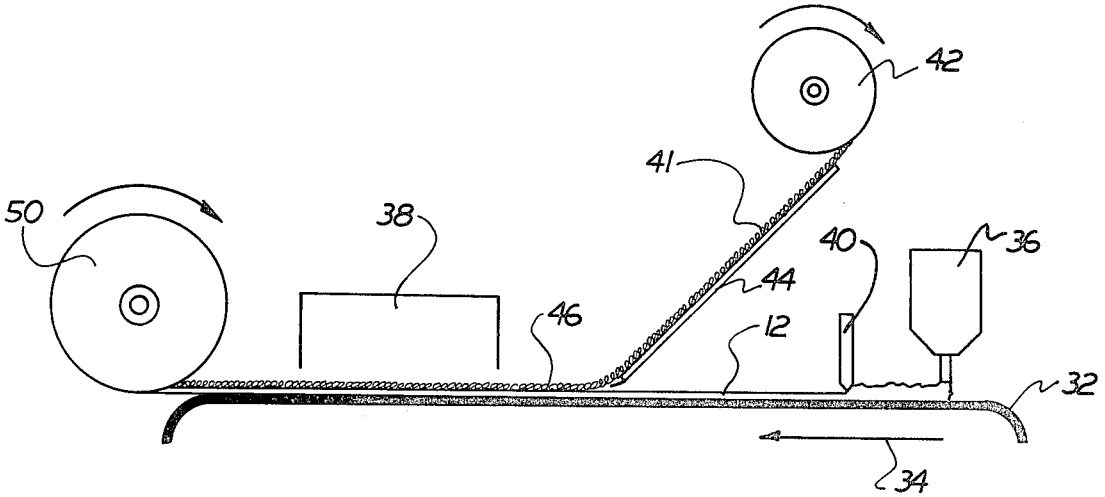
FIG. 5 is a diagramatic and schematic representation of a process and apparatus by which the floor covering of the present invention is produced.

An apparatus for producing floor coverings in accordance with the present invention is shown in FIG. 5. The apparatus includes a flexible belt 32 moving in the direction indicated by the arrow 34. A supply of flexible polymeric material such as a poly(vinyl chloride) plastisol is contained in the vessel 36, and deposited on the belt 32 by any convenient process such as curtain coating. As is well known, plastisol compositions are liquid and are dispersions of dispersion-size polymeric particles in a plasticizer or solvent for the polymer. These plastisols are incomplete solutions and are stable dispersions at ordinary temperatures. To complete the solution and the conversion of the polymer to a solid flexible polymeric material, heat is required. To effect this complete solution and conversion or "solvation" an oven 38 is provided. Solvation proceeds in two stages—gellation, which is partial solvation, and complete solvation to yield a homogeneous, plasticized base layer 12.

In order to regulate the thickness of the base layer 12, there is provided a doctor blade 40 which spans the belt 32 and which functions to control the thickness of the plastisol layer from which the base layer 12 is formed. For most purposes, a final thickness of the base layer 12 will be from 25 to 125 mils and preferably, about 75 mils. A previously tufted piling/primary backing composite is rolled on a supply reel 42 supported above the belt 32. The piling/backing composite 41 is fed from the supply reel 42 onto a guide plate 44 disposed at a suitable angle with respect to the belt 32. A convenient angle is approximately 45°. The leading end 46 of the tufted piling composite is brought into contact with the liquid pool of plastisol adjacent to the discharge end 48 of the plate 44 where lower portions 26 of the loops 18 sink into the liquid plastisol to a point where the primary backing 16 virtually floats on the top of the surface of the liquid plastisol and is carried along with the pool of liquid plastisol. In such a condition, the lower portions 26 of the piling 14 (FIG. 3) which underlie the primary pile backing 16 are submerged in the liquid plastisol from which the base layer 12 will be formed during the thermal solvating process. Thus, the liquid plastisol completely surrounds the submerged lower portions of the loops 26. If chemically compatible materials forming the piling coating 30 and the base layer 12 are used, the fusion process begins upon contact. Also, the liquid plastisol flows into the interstices of the lower portions of the loops 26. The composite then enters the solvating oven 38 to solidify the base 12 and, optionally, to complete the fusion of the coating 30 on the threads 22 to the base 12. Also, the solidification of the portions of the base layer 12 within the interstices of the lower portions of loop 26 mechanically locks the loops into the base. Inasmuch as the plasticizer dispersing medium of the plastisol is compatible with the flexible polymeric coating of the piling, under the influence of the solvating heating oven 38, the piling coating 30 on lower portions of the loop 26 becomes fused with the base material 12 as the base is gelled and solidified in the solvating process. As the completed floor covering material leaves the conveyor belt 32, it is wound up on a take up reel 50. Sufficient length may be provided for spontaneous cooling of the solvated plastisol material on the belt 32 or forced cooling means may be provided as desired.

The resulting floor covering material may then be cut to desired shapes and/or sizes.

Alternatively, it is possible, using the apparatus illustrated in FIG. 5, to form mats which have a border of base material fully surrounding the tufted piling. In accordance with this embodiment, sections of the piling and primary backing composite 41 are cut to appropriate size and are placed on the guide plate 44 at spaced intervals. The precut composite pieces then feed onto the plasticized base layer 12 on the moving belt 32 so that there is an exposed base layer portion between adjacent mats. Following normal solvation in the oven 38, individual, fully bordered mats may be cut from the completed floor covering stock.

The floor covering material of the present invention is characterized by the fact that the piling material 14 is extremely strongly interlocked with the base layer 12. Thus, fraying or piling separation is minimized. Because of the nature of the surface of the coating and the base layer 12, the floor covering materials of the present invention are impermeable to water and easily cleaned. The nature of the looped piling 14 enables the accumulation of snow, mud, etc. from the feet of passers-by and its collection within the loop of the piling. As indicated above, it is readily flushed out with a stream of water and removed from the floor covering material as needed.

In carrying out the present invention, the use of vinyl chloride plastics for forming the thread coatings 30 as well as the base layer 12 is preferred because of the relative availability, chemical compatibility and low cost of these materials in addition to other desired properties. It will be understood that this is merely preferred, however. Other polymeric materials such as polyethylene, polypropylene, polyurethane, ionomer or any other flexible polymer may be used as a piling coating and/or base layer material.

A feature of a preferred embodiment of the present invention is that the base layer 12 and the coating 30 of the pile threads 22 should be of closely similar chemical nature. Thus, in the preferred embodiment, poly(vinyl chloride) is used as the coating 30 for the polyester filaments 28, and a poly(vinyl chloride) or poly(vinyl chloride-vinyl acetate) material may be used for the base layer 12. This base layer may be either foamed or unfoamed. Similarly, copolymers of vinyl chloride such as poly(vinyl chloride-vinyl acetate) may be used. A preferred composition of 2%–10% vinyl acetate copolymerized with vinyl chloride may be used in accordance with the present invention.

As indicated above, the preferred primary backing material 16 is a polyolefin material, such as polypropylene. This material is normally supplied in woven sheets to provide a primary pile backing material to which the piling 14 is tufted by known means. The polyolefin material is unaffected by the plasticizer forming the dispersion medium of the base layer of plastisol. Although the primary backing material 16 may itself ultimately become adhered to the top surface of the solvated base layer 12, it is not essential to the production of a satisfactory floor covering. It is desirable that the primary backing 16 "float" on the top surface of the liquid plastisol as it receives the tufted piling/primary backing composite from the supply roll 42 (FIG. 5). Any thin, flat, relatively strong material may be used for the primary backing 16 in accordance with the present invention since its primary function is to retain the piling loops in place. After installation on the base layer, it serves substantially no function. Thus, the primary backing may be as simple as a sheet of heavy paper or, preferably, it may be formed from threads of natural or synthetic fibers. The fibers may be woven by known means to provide a primary pile backing.

As indicated, the base layer 12 is preferably formed from a plastisol. Plastisols of flexible polymeric material such as homopolymers and copolymers of poly(vinyl chloride) and other formulations are well known. In general, a plastisol is a dispersion of 40% to 70% by weight, preferably 50% to 60% by weight, of fine, dispersion size (1 to 50 micron) polymer in a plasticizer as a dispersion medium. The rigidity or resilience of the solvated plastisol, or fused organisol is determined by the concentration of plasticizer or solvent, as the case may be. Within the ranges stated above, fully solvated vinyl resins are flexible and resilient. From 0.1% to 4.0% by weight of a light and heat stabilizer such as lead carbonate, dibasic lead phosphate or barium-cadmium stabilizer is commonly included in the plastisol formulation. Suitable plasticizer media for formulating plastisols of homopolymers and copolymers of vinyl chloride include esters such as phthalates, phosphates, adipates, epoxidized vegetable oils, polymerics and mixtures of these various plasticizers. These are known, commercially available materials.

The plastisol formulations used in accordance with the present invention may also include from 0% to 45% by weight of fillers and extenders in finely divided form (e.g., −200 mesh). Such materials include barytes, calcium carbonate, barium sulphate, silica, diatomaceous earth, attapulgus clay, microspheres, talc, etc. Frequently, a small amount (0.05% to 0.5%) of a lubricant (internal or external) such as wax, calcium stearate, lead stearate or the like is included in the formulation.

Specific examples of pigments which may be included in both the plastisol and thread coating formulations are: carbon black, cadmium sulfide, zinc oxide, titanium dioxide, barium chromate, lead chromate, $BaCrO_4$—PbO, cobalt aluminate, chromium oxide, etc. or mixtures thereof may be used in normal amounts such as 0.5% to 10% by weight.

The plastisol ingredients are blended in a suitable mixer as is known in the art such as a Littleford, Nauta or Cowles mixer.

Although it will be understood by those skilled in the art that any flexible polymer may be used as a coating 30 on the reinforced piling threads 22, a plasticized poly(-vinyl chloride) formulation is preferred. One typical illustrative formation for the pile coating is as follows:

| | |
|---|---|
| Poly(vinyl chloride) resin | 100 parts |
| Pthalate Plasticizer | 40 parts |
| Epoxidized oil | 6 parts |
| Stabilizer | 4 parts |
| Lubricant | 1 part |
| Pigment | 2 parts |

In a similar manner, several foamed and unfoamed flexible polymer formulations may be used to form the base layer 12. One preferred formulation for the base layer is as follows:

| | |
|---|---|
| Poly(vinyl chloride-vinyl acetate) copolymer resin | 100 parts |
| Pthalate Plasticizer | 75 parts |
| Filler | 75 parts |
| Epoxidized oil | 3 parts |
| Stabilizer | 1 part |
| Pigment | 2 parts |

Another preferred base layer formulation utilizing a mixture of resins is:

| | |
|---|---|
| Poly(vinyl chloride-vinyl acetate) copolymer resin | 70 parts |
| Poly(vinyl chloride) homopolymer resin | 30 parts |
| Pthalate Plasticizer | 75 parts |
| Filler | 75 parts |

-continued

| | |
|---|---|
| Epoxidized oil | 3 parts |
| Stabilizer | 1 part |
| Pigment | 2 parts |

It will be understood by those skilled in the art that the above formulating may also include blowing agents, inert fillers, fungicides, stabilizers and the like.

Numerous other plastisol formulations are well known in the art, commercially available, and can be used in fabricating both the coated fibers and the flexible polymeric base of the floor coverings of the present invention. Such plastisols are first gelled and then fused (solvated) at temperatures generally in the range of 160° to 220° C. as is known. The fusion temperature and minimum residence time in the oven to produce a plasticized flexible polymeric base 12 of poly(vinyl chloride) with coated pile threads 14 coated with poly(vinyl chloride) are fused to and mechanically interlocked by embedment with the upper surface of the base layer 12 will vary with each plastisol or organisol and can be determined quite simply with the apparatus used in making the floor covering.

Residence times will be found, for most purposes, to be in the range of 3 to 30 minutes depending on the temperature achieved in the base, the nature of the plasticizer or mixture of plasticizers used, etc. Residence time will also vary with the thickness of the base 12, thicker sections requiring longer residence times. A heat stabilizer is conveniently included in the pile fiber coating plastisol to aid in preventing degradation of the flexible polymeric coating during transit through the oven, and in use, such as with exposure to hot sun. For this purpose, any known heat and/or light stabilizer may be used in known amounts.

Although plastisols provide a convenient way of handling the flexible polymeric composition used in forming the piling coatings and base layer, it will be understood that solutions of flexible polymer and a plasticizer in a solvent (commonly termed organisols) as distinct from a plastisol form may also be used in either case.

While the invention has been described in a more limited aspects of a preferred embodiment thereof, including specific components and formulations, other embodiments of the invention have been suggested and still others will occur to those skilled in the art upon the reading and understanding of the foregoing specification. It is intended that all such embodiments be included within the scope of the invention as limited only by the appended claims.

Having thus described our invention, we claim:

1. A floor covering composite having a base layer for contacting a floor and a pile portion adapted to be trod upon and comprising:

a fluid impermeable, flexible polymeric base layer adapted to contact a floor surface;

an intermediate woven primary pile backing supported on the upper surface of said base layer; and a looped piling material tufted into said intermediate primary pile backing, the piling having exposed loops above said backing and piling portions projecting below said backing, the piling portions below said backing being embedded in said flexible polymeric base layer, said piling being formed from threads having a reinforcing inner fibrous core and an exterior poly(vinyl chloride) coating, said inner fibrous core having a tensile strength greater than the tensile strength of said exterior coating, said piling portions below said backing being mechanically locked with said base layer.

2. The floor covering composite as set forth in claim 1 wherein said flexible polymeric base layer and said polymeric coating on said piling are chemically compatible and the polymeric base and coating are fused with each other to create an adherent chemical bond therebetween.

3. The floor covering composite as set forth in claim 2 wherein said flexible polymeric base layer and said polymeric coating are both vinyl chloride plastic materials.

4. The floor covering composite as set forth in claim 3 wherein said vinyl chloride plastic material for said flexible polymeric base and polymeric coating are independently selected from a group consisting of homopolymers of vinyl chloride, copolymers of vinyl chloride, and mixtures thereof.

5. The floor covering composite as set forth in claim 2 wherein said base layer comprises a copolymer of vinyl chloride and vinyl acetate.

6. The floor covering composite as set forth in claim 5 wherein said base layer is foamed.

7. The floor covering composite as set forth in claim 1 wherein the underside of said base layer is roughened.

8. The floor covering composite as set forth in claim 6 wherein said primary pile backing is formed of a synthetic resin.

9. The floor covering composite as set forth in claim 8 wherein said synthetic resin is polypropylene.

10. The floor covering composite as set forth in claim 6 wherein said primary pile backing is a woven pile backing.

11. The floor covering composite as set forth in claim 1 wherein said primary pile backing is nonwoven.

12. A floor covering composite as defined in claim 1 wherein said inner fibrous core comprises a bundle of fibers having a poly(vinyl chloride) coating thereon.

13. A floor covering composite having a base layer for contacting a floor and a pile portion adapted to be trod upon and comprising:

a fluid impermeable, flexible polymeric base layer adapted to contact a floor surface;

an intermediate woven primary pile backing supported on the upper surface of said base layer; and a looped piling material tufted into said intermediate primary pile backing, the piling having exposed loops above said backing and piling portions projecting below said backing, the piling portions below said backing being embedded in said flexible polymeric base layer, said piling being formed from threads having a reinforcing inner fibrous core and an exterior polymeric coating, said piling portions below said backing being mechanically locked with said base layer, said piling threads comprising a bundle of polyester fibers having a poly(vinyl chloride) coating thereon.

14. The floor covering composite as set forth in claim 13 wherein said base layer is a solvated poly(vinyl chloride) resin.

* * * * *